US012768556B2

(12) United States Patent
Borisov et al.

(10) Patent No.: US 12,768,556 B2
(45) Date of Patent: Oct. 20, 2026

(54) ADAPTIVE LOGIC BOARD FOR VARIABLE SPEED DRIVE FOR HEATING, VENTILATION, AIR CONDITIONING AND REFRIGERATION SYSTEM

(71) Applicants: JOHNSON CONTROLS AIR CONDITIONING AND REFRIGERATION (WUXI) CO., LTD., Wuxi (CN); JOHNSON CONTROLS TECHNOLOGY COMPANY, Milwaukee, WI (US)

(72) Inventors: Konstantin Alex Borisov, Auburn Hills, MI (US); JonPaul Warriner, Auburn Hills, MI (US); Anuradha Girish Ogale, Auburn Hills, MI (US); Chenyi Jiang, Wuxi (CN); Fei Lu, Wuxi (CN)

(73) Assignees: Johnson Controls Air Conditioning and Refrigeration (Wuxi) Co., Ltd., Wuxi (CN); Tyco Fire & Security GmbH, Neuhausen am Rheinfall (CH)

( * ) Notice: Subject to any disclaimer, the term of this patent is extended or adjusted under 35 U.S.C. 154(b) by 386 days.

(21) Appl. No.: 18/282,746

(22) PCT Filed: Mar. 18, 2021

(86) PCT No.: PCT/CN2021/081473
§ 371 (c)(1),
(2) Date: Sep. 18, 2023

(87) PCT Pub. No.: WO2022/193213
PCT Pub. Date: Sep. 22, 2022

(65) Prior Publication Data
US 2024/0159415 A1 May 16, 2024

(51) Int. Cl.
*F24F 11/63* (2018.01)
*F24F 11/52* (2018.01)

(52) U.S. Cl.
CPC ..... *F24F 11/63* (2018.01); *F24F 11/52* (2018.01)

(58) Field of Classification Search
CPC .. F24F 11/63; F24F 11/52; F24F 11/88; F04D 27/0261; H02P 27/06;
(Continued)

(56) References Cited

U.S. PATENT DOCUMENTS

2007/0035347 A1* 2/2007 Sasaki ..... H03L 7/1075 331/16
2007/0296374 A1* 12/2007 Baudesson ..... H02M 1/126 318/772
(Continued)

FOREIGN PATENT DOCUMENTS

CN 110968001 A 4/2020
GB 2116388 A * 9/1983 ..... H03H 19/008
(Continued)

OTHER PUBLICATIONS

Japanese Office Action for JP Application No. 2023-556993, mailed on Dec. 25, 2024, 5 pages.
(Continued)

*Primary Examiner* — Alicia M. Choi
(74) *Attorney, Agent, or Firm* — Fletcher Yoder, P.C.

(57) ABSTRACT

An adaptive logic board for a variable speed drive (VSD) of a heating, ventilation, air conditioning, and refrigeration (HVAC&R) system includes a signal sensing circuit configured to receive an input signal from a sensor of the VSD. The signal sensing circuit includes a filter configured to condition the input signal. The filter includes a variable resistance element configured to adjust a cutoff frequency of the filter.
(Continued)

The filter is configured to attenuate waveforms in the input signal having frequencies that exceed the cutoff frequency to generate a conditioned signal. The adaptive logic board also includes a controller configured to receive the conditioned signal and to adjust the variable resistance element to adjust the cutoff frequency of the filter based on a parameter of the HVAC&R system.

11 Claims, 8 Drawing Sheets

(58) Field of Classification Search
CPC ..... H03H 2210/012; H03H 2210/028; H03H 2210/036; H03H 21/0001; H03H 7/0153
See application file for complete search history.

(56) References Cited

U.S. PATENT DOCUMENTS

2008/0174258 A1* 7/2008 Schnetzka ..... H05K 7/20936 318/503
2008/0175506 A1* 7/2008 Ota ..... G09G 5/006 382/254
2012/0147922 A1* 6/2012 Lau ..... H03F 3/45475 374/152
2013/0021092 A1* 1/2013 Bhattacharyya ..... H03H 7/06 327/553
2014/0196490 A1* 7/2014 Nemit, Jr. ..... F04C 28/08 62/126
2014/0271232 A1 9/2014 Kopko
2016/0197566 A1* 7/2016 Alvey ..... H02P 1/423 318/816
2020/0041185 A1* 2/2020 Jadric ..... F25B 41/39
2021/0111730 A1* 4/2021 McPhalen ..... H03M 1/12
2022/0115968 A1* 4/2022 Takanuki ..... H02M 1/0006

FOREIGN PATENT DOCUMENTS

JP S6130992 A 2/1986
JP H089683 A 1/1996
JP 2008199591 A 8/2008
JP 2009268351 A 11/2009
JP 2020137303 A 8/2020
WO WO-2019161399 A1 * 8/2019 ..... F24F 11/86
WO 2020152813 A1 7/2020

OTHER PUBLICATIONS

International Search Report for PCT Application No. PCT/CN2021/081473, mailed Apr. 11, 2021, 6 pages.

* cited by examiner

ADAPTIVE LOGIC BOARD FOR VARIABLE SPEED DRIVE FOR HEATING, VENTILATION, AIR CONDITIONING AND REFRIGERATION SYSTEM

CROSS-REFERENCE TO RELATED APPLICATIONS

This application is a U.S. National Stage Application of International Application No. PCT/CN2021/081473, entitled "ADAPTIVE LOGIC BOARD FOR VARIABLE SPEED DRIVE FOR HEATING, VENTILATION, AIR CONDITIONING AND REFRIGERATION SYSTEM," filed Mar. 18, 2021, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

A chiller system for applications in commercial or industrial heating, ventilation, air conditioning, and refrigeration (HVAC&R) systems typically includes a relatively large motor for powering a compressor. A power output of the motor may be selected based on a capacity (e.g., a cooling demand) of the HVAC&R system. For example, the power output of the motor may range in horsepower (HP) from 100 HP to 5,000 HP, or greater than 5,000 HP. Many of these systems include a variable speed drive (VSD) for controlling a speed of the motor in response to variations in the cooling demand of the HVAC&R system. The VSD may increase the speed of the motor and, thus, a speed of the compressor when the cooling demand of the HVAC&R system is increased. Conversely, the VSD may decrease the speed of the motor when the cooling demand of the HVAC&R system is decreased.

A threshold power output of the motor may determine a size (e.g., a power output range) of the VSD utilized in the HVAC&R system. For example, a relatively high powered motor may be controlled by a VSD capable of supporting a higher current draw and voltage demand than a VSD for controlling a relatively low powered motor. Accordingly, different sizes of VSDs may be included in the HVAC&R system to accommodate motors operating over a wide power output range. Each size of VSD may include a logic board (e.g., a printed circuit board) that controls or monitors operation of the VSD. Unfortunately, manufacturing different logic boards for each size of VSD may complicate production and increase manufacturing costs of the logic boards and HVAC&R systems.

SUMMARY

The present disclosure relates to an adaptive logic board for a variable speed drive (VSD) of a heating, ventilation, air conditioning, and refrigeration (HVAC&R) system. The adaptive logic board includes a signal sensing circuit configured to receive an input signal from a sensor of the VSD. The signal sensing circuit includes a filter configured to condition the input signal. The filter includes a variable resistance element configured to adjust a cutoff frequency of the filter. The filter is configured to attenuate waveforms in the input signal having frequencies that exceed the cutoff frequency to generate a conditioned signal. The adaptive logic board also includes a controller configured to receive the conditioned signal and to adjust the variable resistance element to adjust the cutoff frequency of the filter based on a parameter of the HVAC&R system.

The present disclosure also relates to a method of operating a variable speed drive (VSD) using an adaptive logic board. The method includes determining a size of the VSD, where the size of the VSD is based at least in part on a power output range of the VSD, and determining a target cutoff frequency for a filter of a signal sensing circuit of the adaptive logic board based on the size of the VSD. The method also includes adjusting a variable resistance element of the signal sensing circuit to achieve the target cutoff frequency of the filter. The method further includes filtering an input signal received from a sensor of the VSD via the filter to attenuate electrical waveforms in the input signal having a frequency that exceeds the target cutoff frequency and to generate a conditioned signal corresponding to the input signal.

The present disclosure further relates to a heating, ventilation, air conditioning, and refrigeration (HVAC&R) system that includes a variable speed drive (VSD) coupled to a motor of a compressor and configured to control an operational speed of the motor. The HVAC&R system also includes a sensor configured to generate an input signal indicative of an operational parameter of the VSD. The HVAC&R system further includes an adaptive logic board communicatively coupled to the sensor and the VSD. The adaptive logic board includes a signal sensing circuit having a filter configured to receive the input signal from the sensor and to condition the input signal. The filter includes a variable resistance element adjustable to alter a cutoff frequency of the filter. The filter is configured to attenuate electrical waveforms of the input signal having frequencies that exceed the cutoff frequency. The adaptive logic board also includes a controller configured to adjust the variable resistance element to alter the cutoff frequency of the filter based on a parameter of the HVAC&R system.

BRIEF DESCRIPTION OF THE DRAWINGS

Various aspects of this disclosure may be better understood upon reading the following detailed description and upon reference to the drawings in which.

DETAILED DESCRIPTION

Figure 1:
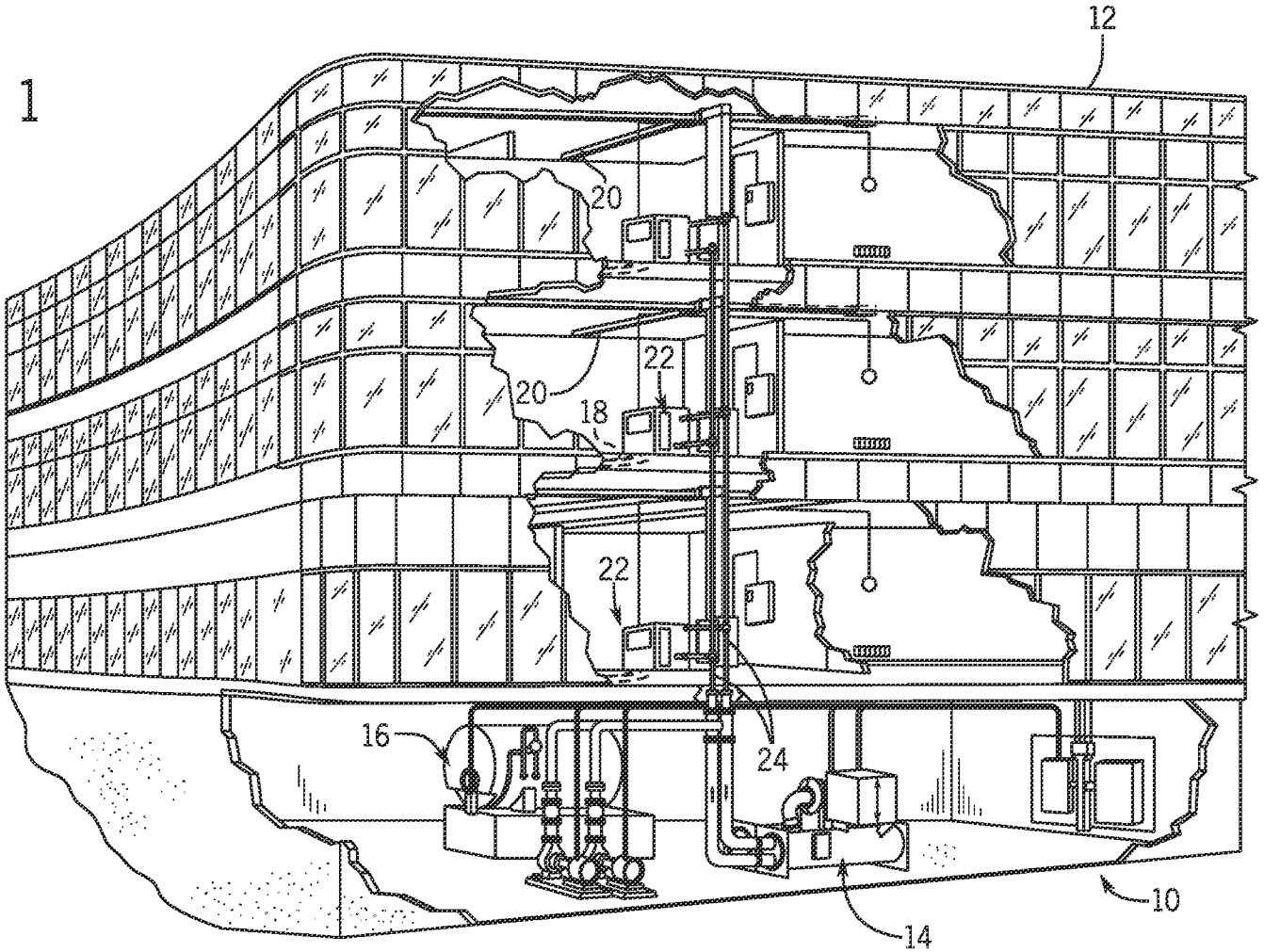
FIG. 1 is a perspective view of an embodiment of a building that may utilize a heating, ventilating, air conditioning, and refrigeration (HVAC&R) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

A heating, ventilation, air conditioning, and refrigeration (HVAC&R) system may be used to thermally regulate a space within a building, home, or other suitable structure. For example, the HVAC&R system may include a vapor compression system that transfers thermal energy between a heat transfer fluid, such as a refrigerant, and a fluid to be conditioned, such as air or water. The vapor compression system may include a condenser and an evaporator that are fluidly coupled to one another via a conduit. A compressor may be used to circulate the refrigerant through the conduit and, thus, enable the transfer of thermal energy between the condenser and the evaporator.

In many cases, the compressor of the HVAC&R system may be driven by a motor. The motor may be communicatively coupled to a control system, which may include a variable speed drive (VSD). The control system may accelerate the motor from zero revolutions per minute (RPM) to a threshold speed. In some cases, the control system may further regulate a magnitude of the threshold speed during operation of the HVAC&R system. A power output of the motor may be selected based on a capacity (e.g., a cooling demand) of the HVAC&R system. In some cases, a size of the VSD is proportional to the rated power output of the motor. For example, a relatively large motor may be controlled by a VSD capable of supplying a larger electric current and voltage than a VSD configured to control a relatively small motor. Accordingly, several sizes of the VSD may be used with the HVAC&R system to control a wide range of motors that have varying power output thresholds.

Each VSD may include a logic board (e.g., a printed circuit board (PCB)) that may monitor and/or control certain operational parameters of the VSD. For example, the logic board may monitor a magnitude of electric current and/or voltage drawn by or supplied to the VSD, a magnitude of electric current and/or voltage output by the VSD (e.g., to the motor), a magnitude of electric current flow through a direct current (DC) bus of the VSD, and/or any other suitable operational parameter of the VSD.

A particular logic board may be configured to accommodate a particular size of VSD and to monitor operating parameters of the particular size of VSD. For example, a logic board configured to monitor operational parameters of a relatively large VSD may include sensing circuitry (e.g., a first set of electrical components) configured to monitor operational parameters of the relatively large VSD, while a logic board configured to monitor operational parameters of a relatively small VSD may include sensing circuitry (e.g., a second set of electrical components) configured to monitor operational parameters of the relatively small VSD. Accordingly, several logic boards may be included in the HVAC&R system, each including different internal components configured to enable monitoring of VSD parameters of a VSD of a particular size. Unfortunately, manufacturing and including multiple different logic boards in the HVAC&R system may complicate assembly and increase production costs of the HVAC&R system.

Embodiments of the present disclosure are directed to an adaptive logic board configured to be implemented in multiple differently-sized VSDs (e.g., different models of VSD) and to monitor operational parameters of the VSDs of various sizes. In particular, the adaptive logic board includes adjustable sensing circuitry that is configured to facilitate monitoring of operational parameters of the VSD at different sampling frequencies that may be selected and/or adjusted based on a size (e.g., model, type) of the VSD. As such, the adaptive logic board may be implemented on a variety of differently-sized VSDs to effectively monitor operation of the VSDs.

For example, the sensing circuity of the adaptive logic board may include at least one signal sensing circuit that is configured to receive an input signal (e.g., an analog signal, an electrical waveform) from a sensor (e.g., voltage transducer, current transducer) of the VSD. The sensor may be configured to monitor a phase of electrical power flowing through a power line of the VSD, control signals transmitted or received by the VSD, and/or other suitable flow of electrical energy through the VSD. Accordingly, the input signal generated by the sensor may be indicative of a frequency, voltage, and/or current of electrical energy flowing through a particular component or portion of the VSD. The signal sensing circuit may include a filter (e.g., a low-pass filter) that is configured to condition or filter the input signal to generate a conditioned signal, which may be transmitted to a data logging component (e.g., an analog-to-digital converter) of the adaptive logic board for processing. As such, the data logging component may convert the conditioned signal from an analog signal to a digital signal, for example. In some embodiments, a relatively large VSD may output a phase of electrical energy or transmit data signals at a first frequency that may be less than a second frequency at which a relatively small VSD outputs the phase of electrical energy or transmits corresponding data signals.

As such, because a frequency of the input signal generated by the sensor and received by the signal sensing circuit may vary based on the size of the VSD to which the adaptive logic board is coupled, a sampling frequency of the data logging component may be adjusted based on the size of the VSD to facilitate acquisition of data corresponding to the monitored operational parameter(s) of the VSD.

To inhibit aliasing during analysis of the conditioned signal received by the data logging component, it is desirable to adjust a cutoff frequency of the filter based on the sampling frequency of the data logging component or, in other words, based on the size of the VSD. In particular, it may be desirable to adjust the cutoff frequency to a value that is less than the sampling frequency of the data logging component (e.g., less than 80 percent of the sampling frequency), such that any electrical waveforms included in the input signal and having frequencies that may cause aliasing when being sampled by the data logging component are substantially attenuated. For clarity, as used herein, the term "aliasing" may be interpreted as understood by one of ordinary skill in the art and as defined herein. For example, "aliasing" of data may refer to distortion of a data signal or generation of artifacts in the data signal when reconstructing the data signal from samples that are different than the original, continuous data signal.

The filter of the signal sensing circuit includes a variable resistance element (e.g., a digital potentiometer) that, as discussed in detail herein, is operable to adjust the cutoff frequency of the filter to a target cutoff frequency that corresponds to the size of the VSD to which the adaptive logic board is coupled. As such, the filter enables sampling of the conditioned signal (e.g., via the data logging component) at various sampling frequencies, substantially without aliasing. A controller of the adaptive logic board may be configured to determine the size of the VSD and generate instructions to adjust a resistance value of the variable resistance element based on the size of the VSD and/or the sampling frequency of the data logging component. The controller may be configured to receive an indication of the size of the VSD to which the adaptive logic board is coupled during installation of the adaptive logic board on the VSD, during start-up of the VSD, of the adaptive logic board, and/or of a chiller system having the VSD, from a remote source (e.g., an external control system, a cloud computing system), or a combination thereof. The controller may, upon receiving an indication of the size of the VSD or otherwise determining the size of the VSD, adjust the cutoff frequency of the filter to the target cutoff frequency corresponding to the size of the VSD. That is, the controller may adjust the cutoff frequency of the filter to a cutoff frequency that enables sampling of the input signal (e.g., via the data logging component) at a desired sampling frequency, substantially without aliasing.

As a non-limiting example, upon determining or receiving an indication that the adaptive logic board is coupled to a relatively large VSD, the adaptive logic board may adjust components (e.g., the variable resistance element) of the signal sensing circuit such that the filter has a first target cutoff frequency (e.g., a relatively low cutoff frequency). As such, the filter may adequately condition a relatively low-frequency input signal that may be output by a sensor of the VSD and received by the signal sensing circuit to enable sampling of the input signal (e.g., via the data logging component) at a first sampling frequency (e.g., a relatively low sampling frequency), substantially without aliasing. Conversely, upon determining or receiving an indication that the adaptive logic board is coupled to a relatively small VSD, the adaptive logic board may adjust components (e.g., the variable resistance element) of the signal sensing circuit such that the filter has a second target cutoff frequency (e.g., a relatively high cutoff frequency) that may be greater than the first target cutoff frequency. As such, the filter may adequately condition a relatively high-frequency input signal that may be output by the sensor of the VSD and received by the signal sensing circuit to enable sampling of the input signal (e.g., via the data logging component) at a second sampling frequency (e.g., a relatively high sampling frequency; a sampling frequency greater than the first sampling frequency), substantially without aliasing. As discussed herein, in this manner, the adaptive logic board may be implemented in various sizes of VSDs to monitor and acquire data of operational parameters the VSD at various sampling frequencies and substantially without aliasing of the acquired data. As such, the adaptive logic board may reduce assembly costs and facilitate production compared to conventional logic boards.

For clarity, as used herein, the "size" of the VSD may be indicative of a type or a model of the VSD implemented in the HVAC system. The model of the VSD may be selected based on one or more operating parameters of the HVAC system such as, for example, a magnitude and/or frequency of alternating current (A/C) or voltage potential supplied to the VSD, a power output range of the VSD, and/or other suitable parameters. For example, in some embodiments, the model or type of VSD (e.g., the size of the VSD) electrically coupled to a motor of the HVAC system may be determined based on a magnitude of an input voltage supplied to the VSD by a power source. As such, a first model of VSD (e.g., a first size of VSD) may be implemented in embodiments where a voltage output of the power source is relatively large and a second model of VSD (e.g., a second size of VSD) may be implemented in embodiments where the voltage output of the power source is relatively small, even though overall power output ranges (e.g., of the electrical current supplied by the VSDs to respective motors) of the first model of VSD and the second model of VSD may be substantially similar to one another. As such, it should be appreciated that various "sizes" of the VSD may be indicative of models or types of VSD configured to receive and/or output electricity at different currents, voltages, and/or frequencies, for example, and/or that have different internal construction, components, and/or layout.

Turning now to the drawings, FIG. 1 is a perspective view of an embodiment of an environment for a heating, ventilation, air conditioning, and refrigeration (HVAC&R) system 10 in a building 12 for a typical commercial setting. The HVAC&R system 10 may include a vapor compression system 14 (e.g., a chiller) that supplies a chilled liquid, which may be used to cool the building 12. The HVAC&R system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
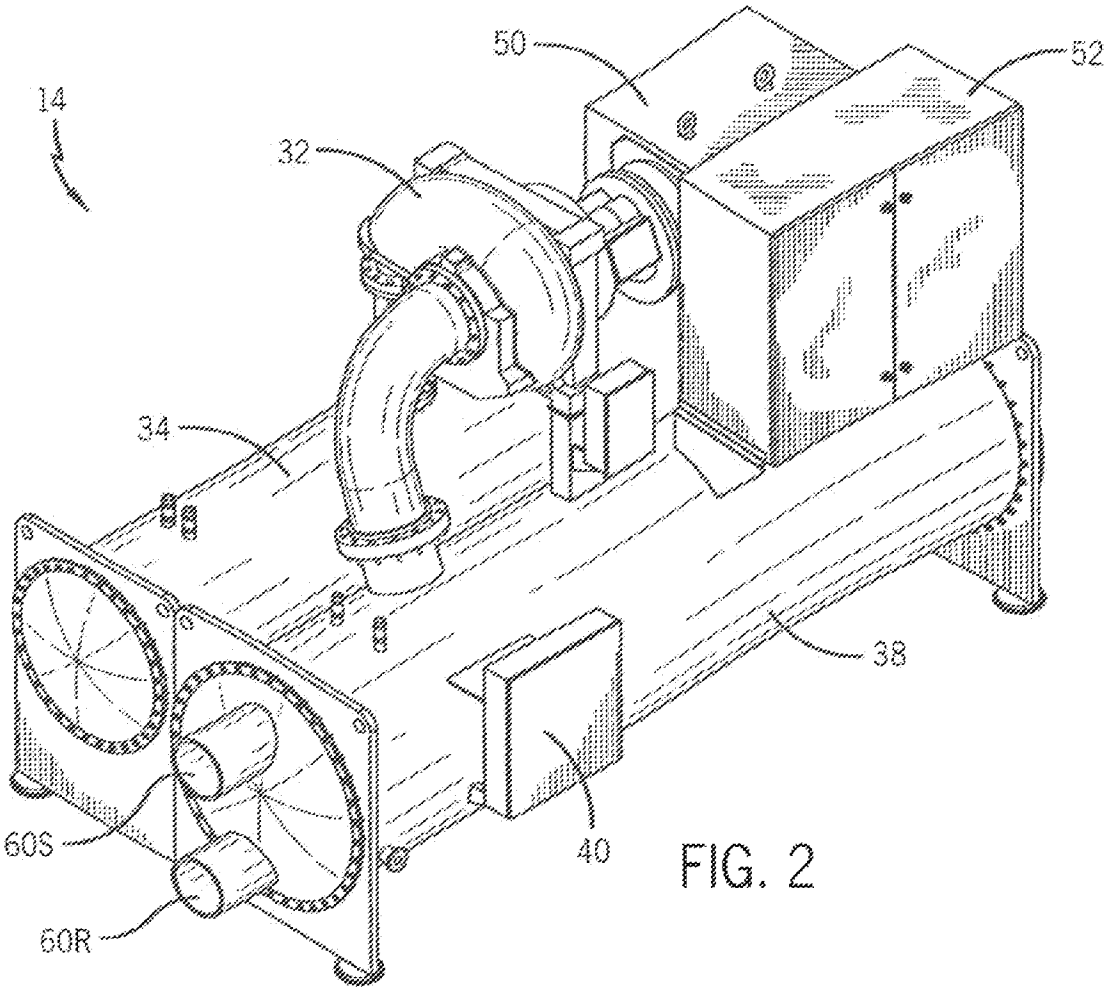
FIG. 2 is a perspective view of an embodiment of a vapor compression system, in accordance with an aspect of the present disclosure.
Figure 3:
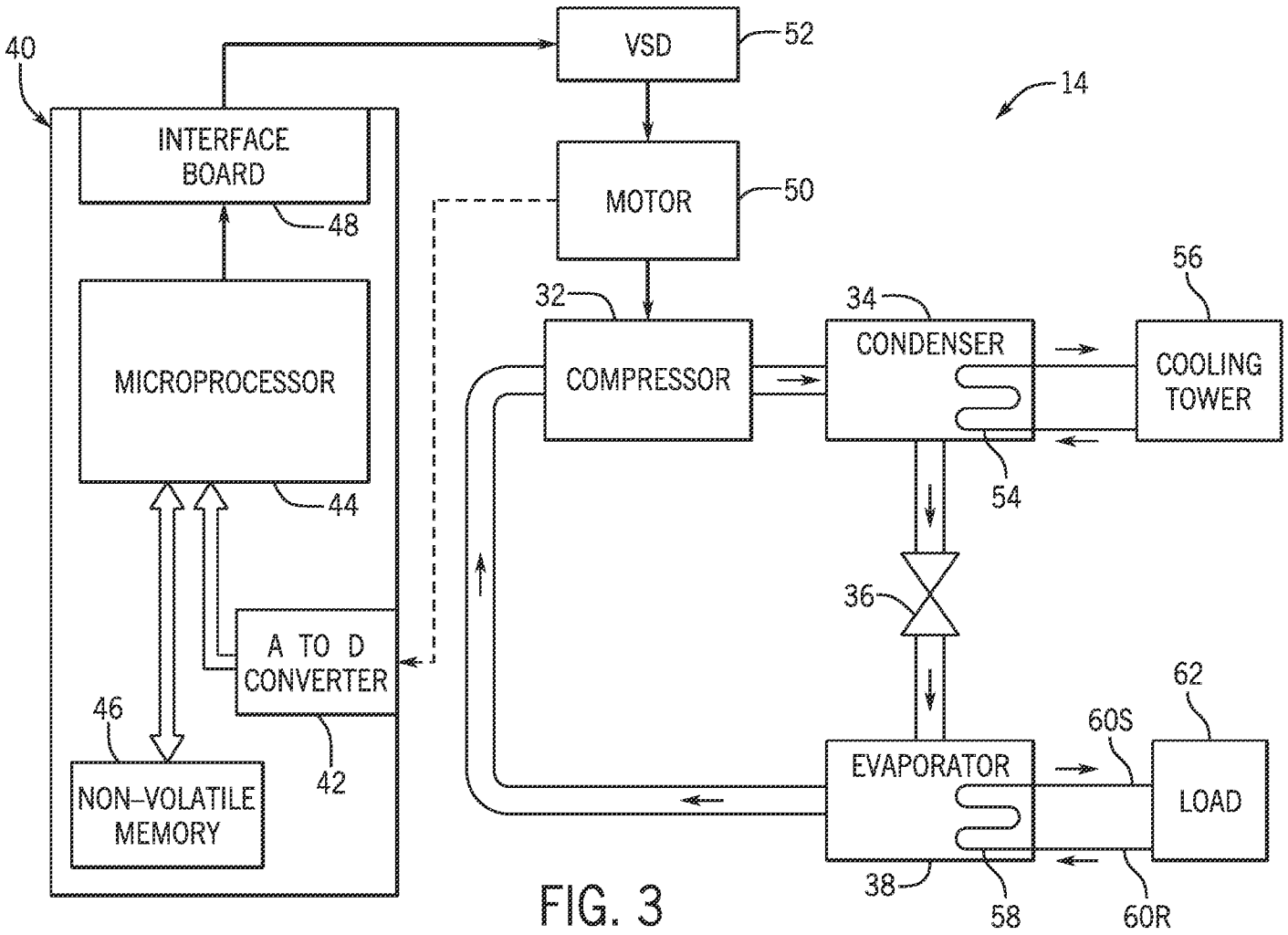
FIG. 3 is a schematic of an embodiment of the vapor compression system of FIG. 2, in accordance with an aspect of the present disclosure.

FIGS. 2 and 3 are embodiments of the vapor compression system 14 that can be used in the HVAC&R system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 that has an analog to digital (A/D) converter 42, a microprocessor 44, a non-volatile memory 46, and/or an interface board 48.

Some examples of fluids that may be used as refrigerants in the vapor compression system 14 are hydrofluorocarbon (HFC) based refrigerants, for example, R-410A, R-407, R-134a, hydrofluoro olefin (HFO), "natural" refrigerants like ammonia ($NH_3$), R-717, carbon dioxide ($CO_2$), R-744, or hydrocarbon based refrigerants, water vapor, or any other suitable refrigerant. In some embodiments, the vapor compression system 14 may be configured to efficiently utilize refrigerants having a normal boiling point of about 19 degrees Celsius (66 degrees Fahrenheit) at one atmosphere of pressure, also referred to as low pressure refrigerants, versus a medium pressure refrigerant, such as R-134a. As used herein, "normal boiling point" may refer to a boiling point temperature measured at one atmosphere of pressure.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The liquid refrigerant from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser 34.

The liquid refrigerant delivered to the evaporator 38 may absorb heat from another cooling fluid, which may or may not be the same cooling fluid used in the condenser 34. The liquid refrigerant in the evaporator 38 may undergo a phase change from the liquid refrigerant to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the vapor refrigerant exits the evaporator 38 and returns to the compressor 32 by a suction line to complete the cycle.

Figure 4:
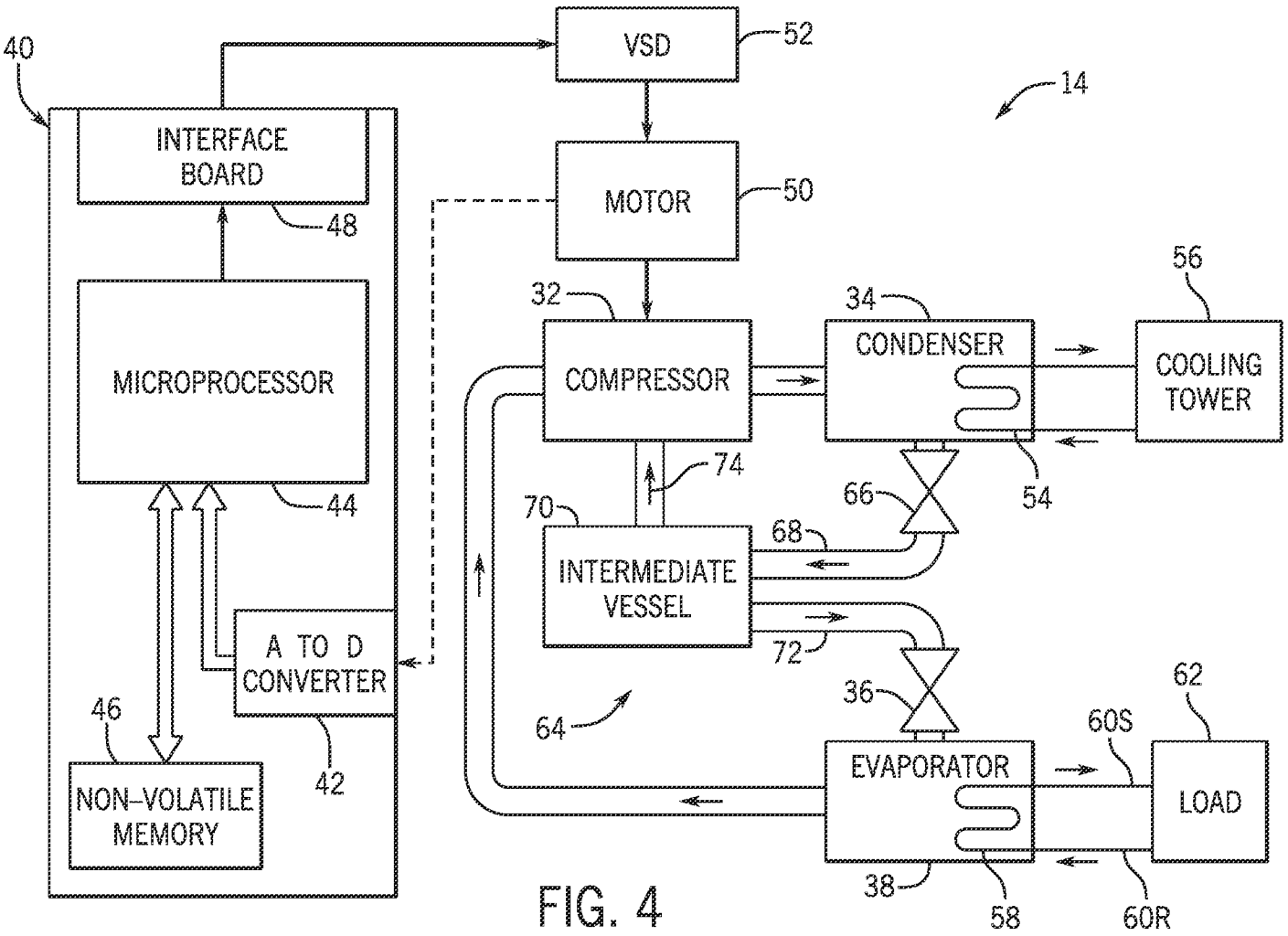
FIG. 4 is a schematic of an embodiment of the vapor compression system of FIG. 2, in accordance with an aspect of the present disclosure.

FIG. 4 is a schematic of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the liquid refrigerant received from the condenser 34. During the expansion process, a portion of the liquid may vaporize, and thus, the intermediate vessel 70 may be used to separate the vapor from the liquid received from the first expansion device 66.

Additionally, the intermediate vessel 70 may provide for further expansion of the liquid refrigerant because of a pressure drop experienced by the liquid refrigerant when entering the intermediate vessel 70 (e.g., due to a rapid increase in volume experienced when entering the intermediate vessel 70). The vapor in the intermediate vessel 70 may be drawn by the compressor 32 through a suction line 74 of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the liquid refrigerant exiting the condenser 34 because of the expansion in the expansion device 66 and/or the intermediate vessel 70. The liquid from intermediate vessel 70 may then flow in line 72 through a second expansion device 36 to the evaporator 38.

In some embodiments, the size (e.g., type, model) of the VSD 52 may be indicative of a magnitude of a power output range (e.g., supply current, supply voltage) that the VSD 52 is configured to generate. For example, a larger VSD may be used to control operation of a relatively large motor (e.g., a 5,000 horsepower (HP) motor) and configured to receive and/or output a relatively large electrical current and/or voltage. Conversely, a smaller VSD may be used to operate a relatively small motor (e.g., a 100 HP motor) and configured to receive and/or output a relatively small electrical current and/or voltage. Additionally or alternatively, as set forth above, the size of the VSD 52 may be indicative of a magnitude of voltage and/or current received at the VSD 52 from a power source (e.g., an A/C power source), for example, and/or indicative of other configurations of the VSD 52.

In some embodiments, various components of the VSD 52 may output and/or or receive electrical power, output and/or receive control signals, and/or otherwise operate at particular frequencies that correspond to and vary based on the size of the VSD 52. As a non-limiting example, in embodiments where the VSD 52 is relatively large, the VSD 52 may be configured to output a phase of electrical power (e.g., to the motor 50) at a first frequency that is relatively low. Conversely, in embodiments where the VSD 52 is relatively small, the VSD 52 may be configured to output the phase of electrical power (e.g. to the motor 50) at a second frequency that is relatively high (e.g., greater than the first frequency). As such, when monitoring an operational parameter of the VSD 52 (e.g., the phase of electrical power output by the VSD 52) and logging data corresponding to the operational parameter (e.g., via a data-logging component of a logic board), it is desirable to adjust a sampling frequency of the data logging component based on a cycling frequency of the monitored operational parameter of the VSD 52 to enhance an accuracy of the data logging operation. Accordingly, embodiments of the present disclosure are directed to an adaptive logic board that includes sensing circuitry having an adjustable sampling frequency and filter cutoff frequency to enable acquisition of data corresponding to one or more monitored operational parameters of the VSD 52, based on the size of the VSD 52, substantially without aliasing. It should be appreciated that any of the features described herein may be incorporated with the vapor compression system 14 or any other suitable HVAC&R systems 10.

Figure 5:
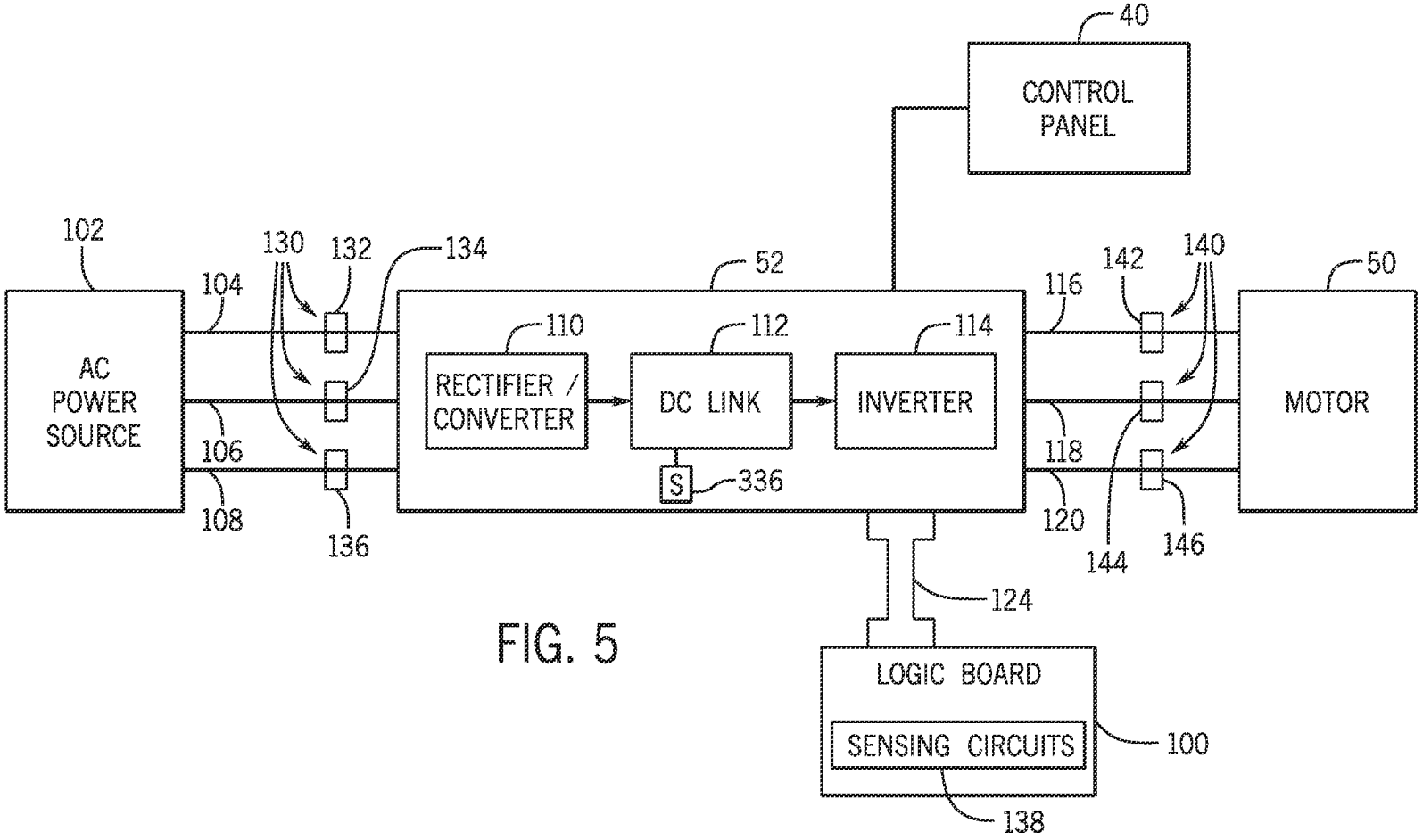
FIG. 5 is a schematic of an embodiment of a variable speed drive (VSD) that may be used in the vapor compression systems of FIGS. 2-4, in accordance with an aspect of the present disclosure.

With the foregoing in mind, FIG. 5 is a schematic diagram of an embodiment of the VSD 52 including an adaptive logic board 100 that may be used to monitor and/or control operation of the VSD 52. It should be understood that the VSD 52 and the adaptive logic board 100 may be used to control the motor 50 of the vapor compression systems 14 of FIGS. 1-4, for example. An alternating current (AC) power source 102 may supply AC power to the VSD 52, which in turn supplies AC power to the motor 50. The AC power source 102 may provide three-phase, fixed voltage, and fixed frequency AC power to the VSD 52 from an AC power grid or distribution system. For example, the AC power source 102 may provide a first phase of AC power, a second phase of AC power, and a third phase of AC power through a first receiving line 104, a second receiving line 106, and a third receiving line 108, respectively.

The AC power may be supplied directly from an electric utility or from one or more transforming substations between the electric utility and the AC power source 102. In some embodiments, the AC power source 102 may supply a three phase AC voltage, or line voltage, of up to 15 kilovolts (kV) at a line frequency of between 50 Hertz (Hz) and 60 Hz to the VSD 52, depending on the corresponding AC power source 102. However, in other embodiments, the AC power source 102 can provide any suitable fixed line voltage or fixed line frequency to the VSD 52 depending on the configuration of the AC power source 102. In addition, a particular site can have multiple AC power sources that can satisfy different line voltage and line frequency demands.

The VSD 52 directs AC power from the AC power source 102 to the motor 50 at a desired voltage and a desired frequency. In certain embodiments, the VSD 52 may provide AC power to the motor 50 having higher voltages and frequencies or lower voltages and frequencies than the fixed voltage and fixed frequency AC power received from the AC power source 102. For example, the VSD 52 may have three internal stages: a converter 110 (e.g., a rectifier), a direct current (DC) link 112, and an inverter 114. The converter 110 may convert the fixed line frequency and/or the fixed line voltage from the AC power source 102 into DC power. The DC link 112 may filter the DC power from the converter 110 and/or store energy via components such as capacitors and/or inductors. The inverter 114 may convert the DC power from the DC link 112 into variable frequency, variable voltage AC power (e.g., three phase AC power) for the motor 50. For example, the inverter 114 may supply the motor 50 with a first phase of AC power, a second phase of AC power, and a third phase of AC power through a first output line 116, a second output line 118, and a third output line 120, respectively.

In some embodiments, the converter 110 may be a pulse width modulated (PWM) boost converter or rectifier having insulated gate bipolar transistors (IGBTs) to provide a boosted DC voltage to the DC link 112 and produce a fundamental root mean square (RMS) output voltage from the VSD 52 that is greater than a fixed nominal fundamental RMS input voltage to the VSD 52. Furthermore, in some embodiments, the VSD 52 may incorporate components in addition to those shown in FIG. 5 to provide the motor 50 with appropriate output voltages and frequencies.

In certain embodiments, the motor 50 may be an induction motor that is capable of being driven at variable speeds. The induction motor can have any suitable pole arrangement including two poles, four poles, six poles, or any suitable number of poles. The induction motor is used to drive a load, such as the compressor 32 of the vapor compression system 14. In other embodiments, the motor 50 may be any suitable motor to drive the compressor 32 and/or another suitable device.

In some embodiments, the adaptive logic board 100 may be communicatively coupled to the VSD 52 via a harness 124 or a plurality of harnesses. The harness 124 may include a plurality of wires (e.g., copper wires, optical fibers), which enable the transmission of data and/or signals between the VSD 52 and the adaptive logic board 100. In some embodiments, the adaptive logic board 100 may monitor and/or control various operating parameters of the electrical power provided to the VSD 52 by the AC power source 102, such as a frequency and/or voltage of the electrical power supplied to the VSD 52 and/or a magnitude of an electric current drawn by the VSD 52.

For example, the adaptive logic board 100 may be communicatively coupled (e.g., via the harness 124) to input sensing units 130, which may be disposed on, about, or adjacent each of the first receiving line 104, the second receiving line 106, and/or the third receiving line 108. Particularly, a first input sensing unit 132 disposed on the first receiving line 104 may monitor the first phase of AC power flowing through the first receiving line 104. The first input sensing unit 132 may include a voltage transducer, a current transducer, or another suitable device or sensor configured to measure a parameter of the first phase of AC power, such as a frequency of the first phase of AC power, a voltage value of the first phase of AC power, and/or a current value of the first phase of AC power, for example. The first input sensing unit 132 may output a signal (e.g., an analog signal, an electrical waveform) that is proportional to a value of the parameter of the first phase of AC power being monitored by the first input sensing unit 132. For example, in embodiments where the first input sensing unit 132 is configured to monitor a frequency of the first phase of AC power supplied to the VSD 52, the first input sensing unit 132 may output an electrical waveform having frequencies that corresponds to (e.g., are substantially equal to) the frequency of the first phase of AC power. Similarly, a second input sensing unit 134 disposed on the second receiving line 106 may monitor a parameter (e.g., frequency, voltage, and/or current) of the second phase of AC power flowing through the second receiving line 106, and a third input sensing unit 136 disposed on the third receiving line 108 may monitor a parameter (e.g., frequency, voltage, and/or current) of the third phase of AC power flowing through the third receiving line 108. As discussed in detail herein, the first, second, and third input sensing units 132, 134, and 136 may be communicatively coupled to one or more signal sensing circuits 138 of the adaptive logic board 100 (e.g., via the harness 124) that is configured to sample the respective signals output by the first, second, and third input sensing units 132, 134, and 136.

The adaptive logic board 100 may additionally or alternatively monitor parameters of the electrical power supplied to the motor 50 by the VSD 52. For example, output sensing units 140 may include a first output sensing unit 142, a second output sensing unit 144, and a third output sensing unit 146 disposed on, about, or adjacent the first output line 116, the second output line 118, and the third output line 120, respectively. Accordingly, the first, second, and third output sensing units 142, 144, and 146 may monitor the first, second, and third phases of AC power flowing through the first, second, and third output lines 116, 118, and 120, respectively. That is, the first, second, and third output sensing unit 142, 144, and 146 may include voltage transducers, current transducers, and/or other suitable devices or sensors configured to measure respective frequencies, voltage values, and/or current values of the first, second, and third phases of AC power. Similar to the input sensing units 130 discussed above, the output sensing units 140 may each be communicatively coupled to the one or more signal sensing circuits 138 of the adaptive logic board 100 via the harness 124.

Figure 6:
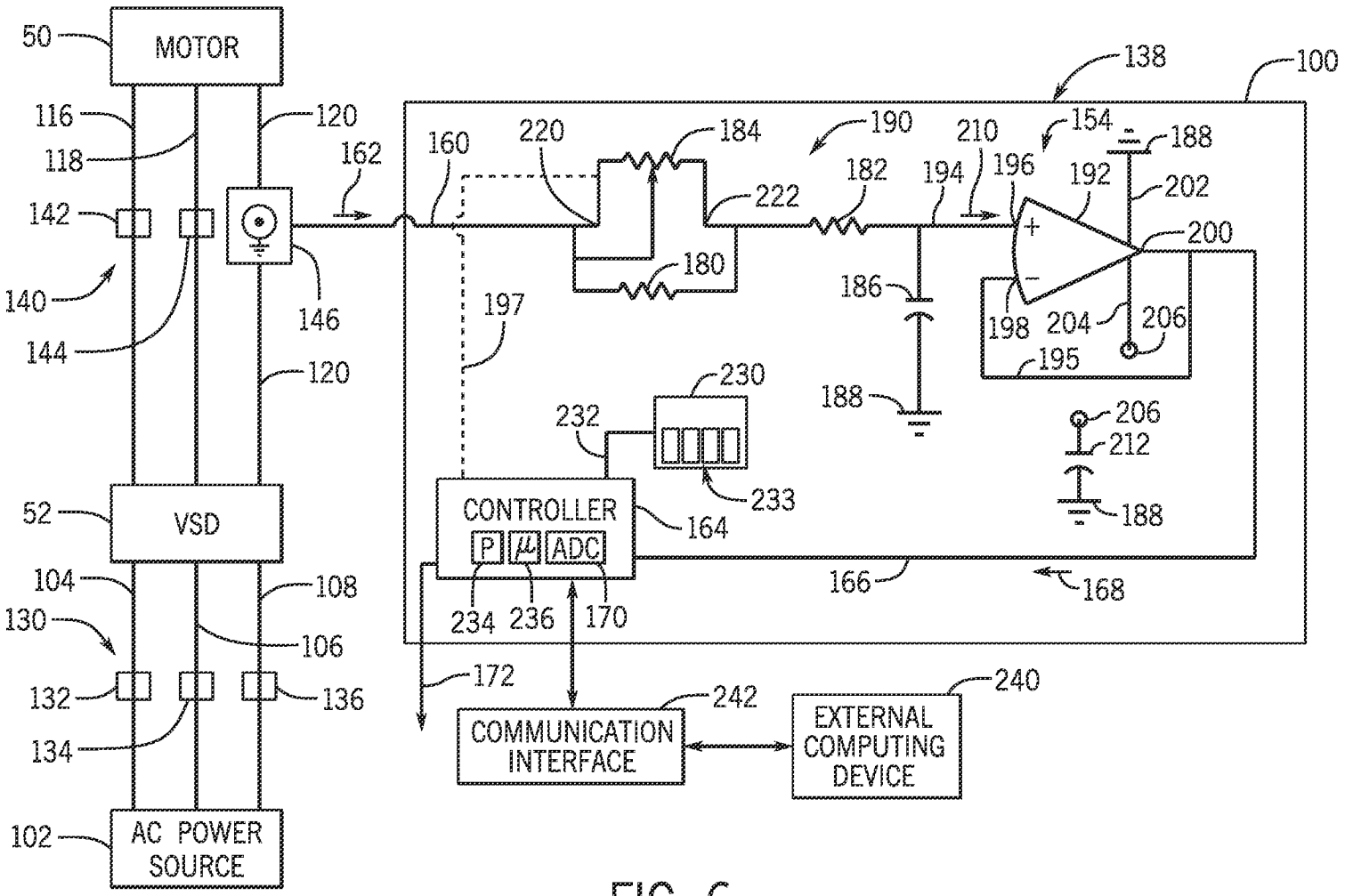
FIG. 6 is a schematic of an embodiment of an adaptive logic board that may be used in the VSD of FIG. 5, in accordance with an aspect of the present disclosure.

FIG. 6 is a schematic diagram of an embodiment of the adaptive logic board 100. As discussed above, the adaptive logic board 100 includes the one or more signal sensing circuits 138 that may be used to analyze the output signals generated by each of the input sensing units 130, each of the output sensing units 140, and/or other suitable sensing units that may be included with the VSD 52. It should be noted that the illustrated embodiment of FIG. 6 shows a single signal sensing circuit 154 of the one or more signal sensing circuits 138, which is associated with, and is configured to analyze, the output signal generated by the third output sensing unit 146. However, as discussed below, the adaptive logic board 100 may include an individual signal sensing circuit that is associated with each of the input sensing units 130 and each of the output sensing units 140 and is configured to monitor a respective output signal of each of the input and output sensing units 130 and 140. Accordingly, in some embodiments, the adaptive logic board 100 may include six signal sensing circuits 138, in which each of the six signal sensing circuits 138 is associated with, and is communicatively coupled to, one of the input sensing units 130 or one of the output sensing units 140. Additionally or alternatively, the adaptive logic board 100 may include additional or fewer than six signal sensing circuits 138. For example, certain embodiments of the adaptive logic board 100 may include 1, 2, 3, 4, 5, 6, or more signal sensing circuits 138. Indeed, it should be appreciated that the adaptive logic board 100 may include a plurality of signal sensing circuits 138 that enable the adaptive logic board 100 to monitor, for example, input currents, voltages, and/or frequencies of the electrical power flowing through the first, second, and third receiving lines 104, 106, 108, output currents, voltages, and/or frequencies of the electrical power flowing through the first, second, and third output lines 116, 118, 118, currents and/or voltages of electrical power flowing through the DC link 112, and/or filter currents of the VSD 52.

In the illustrated embodiment of FIG. 6, the signal sensing circuit 154 includes an input signal line 160 that is electrically coupled to the third output sensing unit 146. In this way, the signal sensing circuit 154 may receive an input signal 162 (e.g., an analog input signal, an electrical waveform) from the third output sensing unit 146. In some embodiments, an overall frequency of the input signal 162 may correspond to a frequency of the phase of AC power flowing through the third output line 120 of the VSD 52. It should be appreciated that, in other embodiments, the input signal line 160 may be coupled to any other suitable sensor or sensing unit configured to monitor a particular operational parameter or parameters of the VSD 52.

The signal sensing circuit 154 may be communicatively coupled to a controller 164 of the adaptive logic board 100 via an output signal line 166. The output signal line 166 may transmit an output signal 168 (e.g., an analog output signal) from the signal sensing circuit 154 to the controller 164. As discussed in detail herein, the output signal 168 may correspond to a form of the input signal 162 that has been conditioned (e.g., filtered) by the signal sensing circuit 154. The controller 164 may include a data logging component 170 (e.g., an analog-to-digital converter) configured to analyze (e.g., sample) the output signal 168 and generate data signals (e.g., digital data) corresponding to the operational parameter monitored by the signal sensing circuit 154. Particularly, the data logging component 170 may be configured to sample the output signal 168 at a particular sampling frequency to generate a digital output 172 (e.g., a digital data signal) that corresponds to the input signal 162. That is, the digital output 172 may include data indicative of a value of the operational parameter being monitored by the signal sensing circuit 154 such as, for example, a frequency, voltage, and/or current of the phase of electrical power flowing through the third output line 120. The controller 164 may transfer the digital output 172 to other control circuitry of the vapor compression system 14 and/or may utilize the digital output 172 to control/adjust operation of the VSD 52.

In the illustrated embodiment, the signal sensing circuit 154 includes a first resistor 180, a second resistor 182, a variable resistance element 184, and a first capacitor 186 that are electrically coupled to the input signal line 160. The first resistor 180 and the variable resistance element 184 are electrically coupled to the input signal line 160 in parallel with one another, while the second resistor 182 is electrically coupled to the input signal line 160 in series with the first resistor 180 and the variable resistant element 184. The first capacitor 186 may be electrically coupled to the input signal line 160 and a ground 188 (e.g., an electrical ground) of the adaptive logical board 100. The first resistor 180, the second resistor 182, the variable resistance element 184, and the first capacitor 186 may collectively form at least a portion of a filter 190 (e.g., a low-pass filter) of the signal sensing circuit 154. As discussed in detail below, the filter 190 may be operable to condition the input signal 162 to attenuate or remove certain frequencies of the input signal 162 that, when sampled by the controller 164, may result in aliasing of the input signal 162.

The signal sensing circuit 154 may include an operational amplifier 192 that is electrically coupled to the filter 190 via a line 194. In particular, the line 194 may electrically couple the filter 190 to a first input terminal 196 (e.g., a non-inverting input terminal) of the operational amplifier 192. A second input terminal 198 (e.g., an inverting input terminal) of the operational amplifier 192 may be electrically coupled to an output terminal 200 of the operational amplifier 192 via a line 195. The operational amplifier 192 may include a first lead 202 that is electrically coupled to the ground 188 and a second lead 204 that is electrically coupled to a power supply 206 (e.g., a positive voltage source) that is configured to supply a voltage differential (e.g., 0 Volts±20 Volts) that enables operation of the operational amplifier 192. The operational amplifier 192 may include a predetermined or adjustable gain and may amplify a magnitude of a conditioned signal 210 received from the filter 190 to generate the output signal 168. As discussed in greater detail below, the conditioned signal 210 may be indicative of a form of the input signal 162 that has been conditioned (e.g., filtered) by the filter 190 to attenuate certain frequencies of electrical waveforms that may be present in the input signal 162. By amplifying the magnitude of the conditioned signal 210 (e.g., to generate the output signal 168), the operational amplifier 192 may facilitate sampling of the conditioned signal 210 via the controller 164 (e.g., via the data logging component 170 of the controller 164). In certain embodiments, a second capacitor 212 may be electrically coupled to the ground 188 and the power supply 206 to mitigate fluctuations in voltage that may be provided to the operational amplifier 192 by the power supply 206 and, thus, enable effective operation of the operational amplifier 192.

In some embodiments, the first resistor 180 and the second resistor 182 may each include a fixed resistance value, and the first capacitor 186 and the second capacitor 212 may each include a fixed capacitance value. For example, the resistance value of the first resistor 180 may be between about 1000 Ohms and about 4000 Ohms, while the resistance value of the second resistor 182 may be between about 500 Ohms and about 3000 Ohms. The capacitance value of the first capacitor 186 and the second capacitor 212 may each be between about 2000 Picofarad and 4000 Picofarad.

The variable resistance element 184 is operable to adjust a resistance value (e.g., a resistivity) between an input terminal 220 and an output terminal 222 of the variable resistance element 184. For example, the variable resistance element 184 may include a digital potentiometer, a multiplying digital-to-analogue converter (MDAC), or another suitable device that is operable to adjust a resistance value between the input and output terminals 220, 222. As a non-limiting example, the variable resistance element 184 may be operable to selectively adjust a resistance value between the input terminal 220 and the output terminal 222 to be between about 0 Ohms and about 10,000 Ohms.

In some embodiments, the controller 164 may be communicatively and/or electrically coupled to the variable resistance element 184 via a communication line 197. As discussed in detail below, the controller 164 may be configured to instruct the variable resistance element 184 (e.g., via control signals transmitted on the communication line 197) to adjust the resistance value between the input terminal 220 and the output terminal 222 based on one or more inputs received at the controller 164. To this end, the controller 164 may, based on the received inputs, operate the variable resistance element 184 to adjust a cutoff frequency of the filter 190 between multitudinous discrete values.

For example, in some embodiments, a cutoff frequency of the filter 190 may be represented by the equation $f=1/(2\pi RC)$, where "f" represents the cutoff frequency of the filter 190, "R," also referred to herein as an "R-value," represents a resultant resistance of at least the first resistor 180, the second resistor 182, and the variable resistance element 184, and "C" represents a capacitance value of at least the first capacitor 186. The controller 164 may adjust the resultant resistance value "R" of the equation above by adjusting the resistance across the variable resistance element 184. As such, the controller 164 may adjust the cutoff frequency of the filter 190 via control of the resistance value of the variable resistance element 184. As discussed below, the filter 190 may condition (e.g., filter) the input signal 162 received at the filter 190 to substantially attenuate electrical waveforms in the input signal 162 that have a frequency above the cutoff frequency to which the filter 190 is set. Accordingly, the conditioned signal 210 output by the filter 190 may be a form of the input signal 162 having that does not include, or is substantially devoid of, electrical waveforms having a frequency above the cutoff frequency of the filter 190.

In some embodiments, the controller 164 may adjust the cutoff frequency of the filter 190 to a target cutoff frequency based on a size of the VSD 52 to which the adaptive logic board 100 is coupled. In certain embodiments, the controller 164 may be configured to determine the size of the VSD 52 coupled to the adaptive logic board 100 based on a configuration of a dual in-line package (DIP) switch 230 or other switching device that is communicatively coupled (e.g., via line 232) to the controller 164. The DIP switch 230 may be coupled to the VSD 52, to a chassis of the adaptive logic board 100, or to any other suitable component of the vapor compression system 14. The DIP switch 230 may include one or more switches 233 that may each be adjustable (e.g., via input from an operator of the vapor compression system 14) to discrete positions (e.g., on/off positions, up/down positions). A particular configuration of the switches 233 may correspond to the size of the VSD 52. For example, positioning the switches 233 in a first configuration may indicate that the adaptive logic board 100 is coupled to a relatively large VSD 52, while positioning the switches 233 in a second configuration may indicate that the adaptive logic board 100 is coupled to a relatively small VSD 52. An operator of the vapor compression system 14 may adjust the switches 233 of the DIP switch 230 to the corresponding setting when installing the adaptive logic board 100 on a particular size of the VSD 52.

The controller 164 may include a processor 234 that may determine the size (e.g., model, type) of the VSD 52 coupled to the adaptive logic board 100 based on the configuration of the DIP switch 230. For example, upon activation of the compressor 32, the VSD 52, and/or the adaptive logic board 100, the processor 234 may determine a configuration of the switches 233 of the DIP switch 230. The processor 234 may reference a look-up table that is stored on a memory device 236 of the controller 164 and correlates particular configurations of the switches 233 to various sizes of the VSD 52. As such, the processor 234 may utilize the look-up table to determine a size of the VSD 52 based on the configuration of the switches 233.

It should be understood that the processor 234 may include a microprocessor that may execute software for controlling components of the adaptive logic board 100, such as the variable resistance element 184, components of the VSD 52, and/or other components of the vapor compression system 14. Moreover, the processor 234 may include multiple microprocessors, one or more "general-purpose" microprocessors, one or more special-purpose microprocessors, and/or one or more application specific integrated circuits (ASICs), one or more field-programmable gate arrays (FPGAs), one or more digital signal processors (DSPs), or some combination thereof. For example, the processor 234 may include one or more reduced instruction set (RISC) processors. The memory device 236 may store information such as control software, look-up tables, configuration data, executable instructions, and any other suitable data. The memory device 236 may include a volatile memory, such as random access memory (RAM), and/or a nonvolatile memory, such as read-only memory (ROM). The memory device 236 may store processor-executable instructions including firmware or software for the processor 234 to execute, such as instructions for controlling the components of the adaptive logic board 100 and/or the VSD 52. In some embodiments, the memory device 236 is a tangible, non-transitory, machine-readable-medium that may store machine-readable instructions for the processor 234 to execute. The memory device 236 may include ROM, flash memory, a hard drive, or any other suitable optical, magnetic, or solid-state storage medium, or a combination thereof.

In some embodiments, the controller 164 may determine the size of the VSD 52 to which the adaptive logic board 100 is coupled based on an input signal received from an external computing device 240 that is communicatively coupled to the controller 164 via a communication interface 242. The external computing device 240 may include a computer, a tablet, a smart wearable device, a display, or another suitable computing device that enables an operator to input the size of the VSD 52. The communication interface 242 may, via a wireless or wired communication technique (e.g., Wi-Fi, near field communication, Bluetooth, Zigbee, Z-wave, ISM, an embedded wireless module, another suitable wireless communication technique, or a wired connection), transmit the operator input signal indicating the size of the VSD 52 from the external computing device 240 to the controller 164. As such, the controller 164 may utilize the input signal received at the external computing device 240 to adjust operation of the adaptive logic board 100 based on the size of the VSD 52 coupled to the adaptive logic board 100. It should be appreciated that the external computing device 240 may include processing circuitry that is independent of and distinct from the controller 164.

In some embodiments, the controller 164 may determine the size of the VSD 52 based off a structure of the harness 124 (see FIG. 5). For example, a particular harness may be associated with each size, or a range of sizes, of the VSD 52. The harness 124 may include additional or fewer connection wires depending on the size of the associated VSD 52. For example, a harness associated with a relatively large VSD 52 may include a first quantity of connection wires (e.g., a large quantity of connection wires), while a harness associated with a relatively small VSD 52 may include a second quantity of connection wires (e.g., a small quantity of connection wires). In some embodiments, the harness 124 may electrically couple to the adaptive logic board 100 via a universal plug (e.g., a terminal plug). The universal plug may include a predetermined amount of connections ports, of which a first quantity of the connection ports are electrically coupled to the connection wires. Accordingly, in some embodiments, a second quantity (e.g., a remaining quantity) of the connection ports may remain vacant. The controller 164 may determine a quantity of connection wires included in the universal plug, and a quantity of vacant connection ports and, thus, determine a size of the VSD 52.

For example, the controller 164 may send a test signal to each connection port of the plurality of connection ports, and determine whether a particular connection port communicatively couples the adaptive logic board 100 to the VSD 52. Accordingly, the adaptive logic board 100 may determine a number of established connection ports and a number of connection ports that are left vacant. The adaptive logic board 100 may use the number of established connection ports and the number of vacant connection ports to determine the size of the VSD 52. As a non-limiting example, three vacant positions may indicate that the adaptive logic board 100 is coupled to a relatively small VSD, while no vacant positions may indicate that the adaptive logic board 100 is coupled to a relatively large VSD.

In some embodiments, multiple harnesses may be used to electrically couple the adaptive logic board 100 to the VSD 52. For example, the adaptive logic board 100 may include respective harnesses that are associated with various communication, voltage sensing, and/or current sensing features of the adaptive logic board 100. In some embodiments, the controller 164 may be configured to determine a size of the VSD 52 based on these additional harnesses in addition to, or in lieu of, the harness 124. That is, in some embodiments, the controller 164 may determine a size of the VSD 52 based on a structure of and/or communications from any one harness or combination of harnesses that may be used to electrically couple the adaptive logic board 100 to the VSD 52. As such, in accordance with the techniques discussed above, the adaptive logic board 100 may determine a size of the VSD 52 by identifying, for example, a number of established connection ports in the additional harnesses and the number of vacant connection ports in the additional harnesses. Additionally or alternatively, the adaptive logic board 100 may determine the size of the VSD based on an identification code that may be stored within one or more of the harnesses (e.g., through respective memory devices disposed within the harnesses).

In any case, upon determining the size of the VSD 52 to which the adaptive logic board 100 is coupled, the controller 164 may adjust (e.g., via control signals transmitted on the communication line 197) the variable resistance element 184 to achieve a target cutoff frequency of the filter 190 that corresponds to the size of the VSD 52. As such, the filter 190 may effectively attenuate frequencies of the input signal 162 that exceed the target cutoff frequency and which may otherwise cause aliasing when being sampled by the controller 164 (e.g., via the data logging component 170).

In some embodiments, the controller 164 may reference a look-up table stored in the memory device 236 to determine the target cutoff frequency of the filter 190 that corresponds to the size of the VSD 52 associated with the adaptive logic board 100. Additionally or alternatively, the controller 164 may receive feedback indicative of the target cutoff frequency from the external computing device 240. In any case, upon determining the size of the VSD 52 to which the adaptive logic board 100 is coupled, the controller 164 may adjust the resistance of the variable resistance element 184 to achieve the desired target cutoff frequency of the filter 190 that corresponds to the size of the VSD 52. As discussed below, in this manner, the controller 164 may configure the signal sensing circuit 154 to more effectively condition in the input signal 162 received from the third output sensing unit 146, for example.

Figure 7:
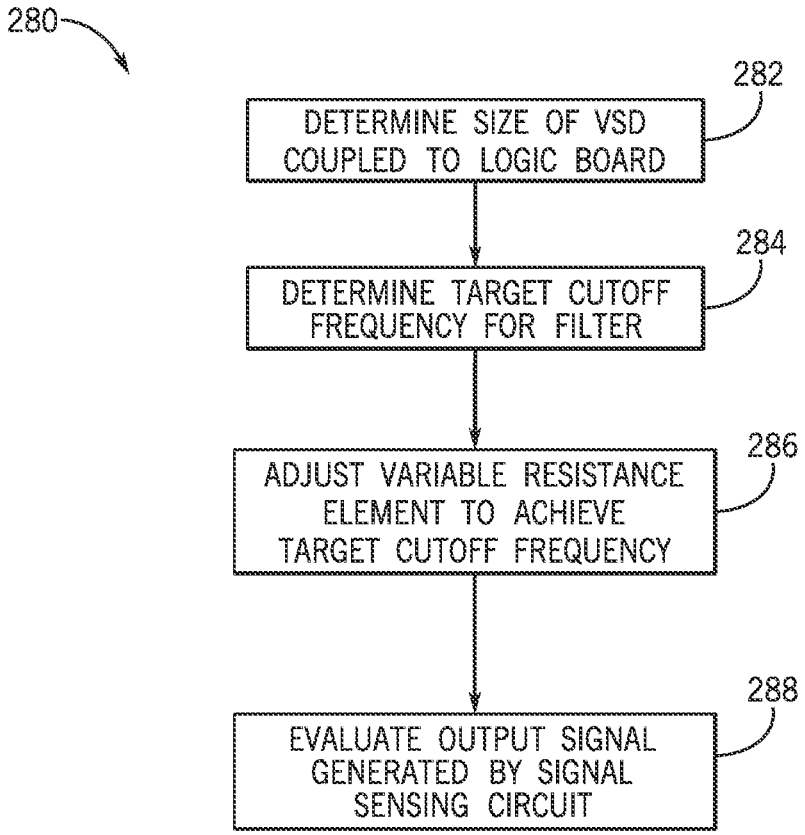
FIG. 7 is a flow diagram of an embodiment of a method for operating the adaptive logic board of FIG. 6, in accordance with an aspect of the present disclosure.

FIG. 7 is a flow diagram of an embodiment of a method 280 for operating the adaptive logic board 100 to evaluate input signals (e.g., the input signal 162) received from sensors (e.g., the sensing units 130, 140) of the VSD 52. FIGS. 6 and 7 will be referred to concurrently throughout the following discussion. It should be noted that the steps of the method 280 discussed below may be performed in any suitable order and are not limited to the order shown in the illustrated embodiment of FIG. 7. Moreover, it should be noted that additional steps of the method 280 may be performed and certain steps of the method 280 may be omitted, in certain embodiments. Still further, it should be appreciated that certain of the steps of the method 280 may be performed concurrently with other steps. The method 280 may be executed by the processor 234 of the controller 164 and/or by other suitable processing circuitry of the vapor compression system 14. It should be appreciated that, although the following discussion refers to adjustment of components of the signal sensing circuit 154, the method 280 may be implemented to adjust corresponding components of any other signal sensing circuits included in the one or more signal sensing circuits 138, in accordance with the disclosed techniques.

The method 280 includes determining a size of the VSD 52, as indicated by block 282. For example, in accordance with the aforementioned techniques, the controller 164 may determine the size of the VSD 52 based on a configuration of the DIP switch 230, based on operator input signals received for the external computing device 240, based on a structure and/or utilization of the harness 124, or via another suitable technique. Upon determining the size of the VSD 52, the controller 164 may determine a target cutoff frequency for the filter 190 of the signal sensing circuit 154 that corresponds to the size of the VSD 52, as indicated by block 284. For example, the controller 164 may reference a look-up table stored in the memory device 236 and/or receive feedback from the external computing device 240 indicating the target cutoff frequency of the filter 190 that corresponds the particular VSD 52 to which the adaptive logic board 100 is coupled.

In some embodiments, concurrently, before, or after execution of block 284, the controller 164 may, based on the size of the VSD 52, determine a sampling frequency of the data logging component 170. For example, the controller 164 may set the sampling frequency of the data logging component 170 to a relatively low sampling frequency (e.g., a first target sampling frequency) upon determining or receiving an indication that the adaptive logic board 100 is coupled to a relatively large VSD 52. Conversely, the controller 164 may set the sampling frequency of the data logging component 170 to a relatively high sampling frequency (e.g., a second target sampling frequency greater than the first target sampling frequency) upon determining or receiving an indication that the adaptive logic board 100 is coupled to a relatively small VSD 52. Further, in some embodiments, the controller 164 may determine the target cutoff frequency of the filter 190 based on the sampling frequency of the data logging component 170. As a non-limiting example, the controller 164 may set the target cutoff frequency of the filter 190 to be a percentage of (e.g., a predetermined percentage of) the sampling frequency of the data logging component 170, which may be determined based on the size of the VSD 52 to which the adaptive logic board 100 is coupled. Accordingly, in such embodiments, the controller 164 may indirectly adjust the cutoff frequency of the filter 190 based on the size of the VSD 52.

In any case, the method 280 includes adjusting the variable resistance element 184 to achieve the target cutoff frequency of the filter 190, as indicated by block 286. In some embodiments, the appropriate resistance value of the variable resistance element 184 that achieves the target cutoff frequency of the filter 190 may be stored in the memory device 236. As such, the controller 164 may reference data stored in the memory device 236 to determine the appropriate resistance setting of the variable resistance element 184 that achieves the determined target cutoff frequency of the filter 190. In other embodiments, the controller 164 may be configured to calculate the appropriate resistance setting of the variable resistance element 184 using the equation set forth above. In any case, the controller 164 may adjust the variable resistance element 184 to achieve the target cutoff frequency corresponding to the size of the VSD 52. Upon adjusting the variable resistance element 184 to achieve the target cutoff frequency of the filter 190, the controller 164 may evaluate the output signal 168 generated by the signal sensing circuit 154, as indicated by block 288.

As an example, upon determining or receiving an indication that the adaptive logic board 100 is coupled to a relatively large VSD 52, the controller 164 may adjust the filter 190 (e.g., via instructions sent to the variable resistance element 184) to have a first target cutoff frequency, which may correspond to a relatively low cutoff frequency (e.g., between about 10 kilo-Hertz (kHz) and about 19 kHz). As such, the filter 190 may receive the input signal 162 and attenuate electrical waveforms in the input signal 162 having frequencies above the first target cutoff frequency to generate the conditioned signal 210. To this end, the conditioned signal 210 may be indicative of the input signal 162 with any frequencies of electrical waveforms above the first target cutoff frequency substantially attenuated. The operational amplifier 192 may receive the conditioned signal (e.g., at the input terminal 220) and amplify the conditioned signal 210 to generate the output signal 168. The controller 164 may receive the output signal 168 and sample the output signal 168 at a first sampling frequency (e.g., a relatively low sampling frequency) via the data logging component 170. As such, the data logging component 170 may generate the digital output 172 that corresponds to the input signal 162. The first sampling frequency of the data logging component 170 may exceed the first target cutoff frequency. For example, the first sampling frequency may be between about 17 kHz and 24 kHz. In some embodiments, the controller 164 may adjust the target cutoff frequency of the filter 190 and/or the sampling frequency of the data logging component 170 such that the target cutoff frequency is a percentage of (e.g., between 70 percent and 80 percent of) the first sampling frequency.

Conversely, upon determining or receiving an indication that the adaptive logic board 100 is coupled to a relatively small VSD 52, the controller 164 may adjust the filter 190 (e.g., via instructions sent to the variable resistance element 184) to include a second target cutoff frequency, which may correspond to a relatively high cutoff frequency (e.g., between about 18 kHz and about 35 kHz). As such, the filter 190 may receive the input signal 162 and attenuate electrical waveforms in the input signal 162 having frequencies above the second target cutoff frequency to generate the conditioned signal 210. As such, the conditioned signal 210 may be indicative of the input signal 162 with any frequencies of electrical waveforms above the second target cutoff frequency substantially attenuated. The operational amplifier 192 may receive the conditioned signal 210 (e.g., at the input terminal 220) and amplify the conditioned signal 210 to generate the output signal 168. The controller 164 may receive the output signal 168 and sample the output signal 168 at a second sampling frequency via the data logging component 170, which may be greater than the first sampling frequency. As such, the data logging component 170 may generate the digital output 172 that corresponds to the input signal 162. The second sampling frequency of the data logging component 170 may exceed the second target cutoff frequency. For example, the second sampling frequency may be between about 24 kHz and 45 kHz. In some embodiments, the controller 164 may adjust the target cutoff frequency of the filter 190 and/or the sampling frequency of the data logging component 170 such that the target cutoff frequency is a percentage of (e.g., between 70 percent and 80 percent of) the second sampling frequency.

It should be understood that, in certain embodiments, the filter 190 may include additional or fewer components than those shown in the illustrated embodiment of FIG. 6. Indeed, the filter 190 may include any suitable array of components that enable a cutoff frequency of the filter 190 to be adjusted in accordance with the techniques discussed herein (e.g., based on control signals provided via the controller 164). To name some examples, the filter 190 may include a Sallen-Key filter, a passive or active variable filter, or another suitable filter architecture.

Figure 8:
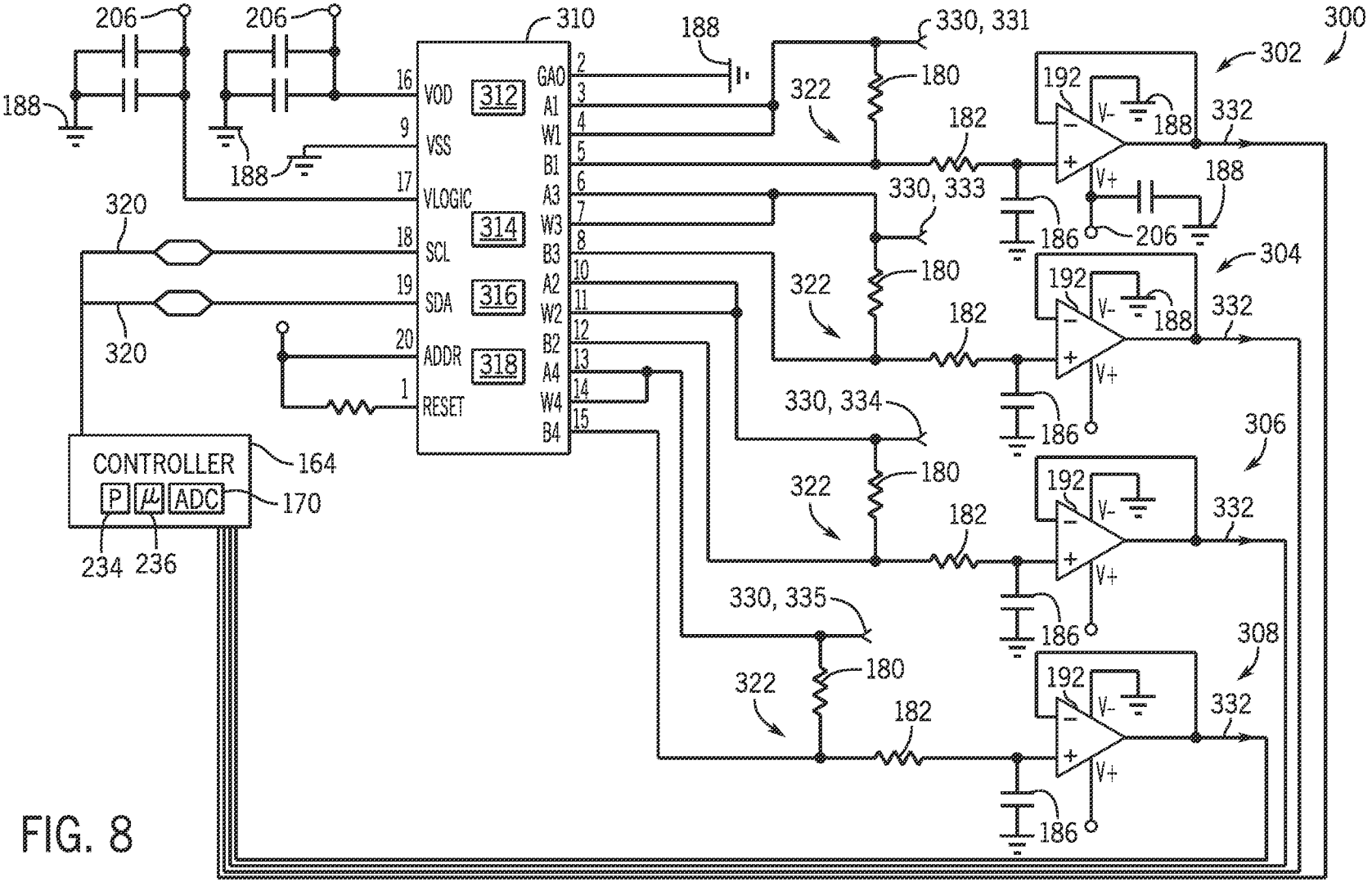
FIG. 8 is a schematic of an embodiment of signal sensing circuitry that may be included in the adaptive logic board of FIG. 6, in accordance with an aspect of the present disclosure.

FIG. 8 is a schematic of an embodiment of a portion of the adaptive logic board 100, illustrating a plurality of signal sensing circuits 300. In particular, the adaptive logic board 100 includes a first signal sensing circuit 302, a second signal sensing circuit 304, a third signal sensing circuit 306, and a fourth signal sensing circuit 308. The first, second, third, and fourth signal sensing circuits 302, 304, 306, 308 may each include some of or all of the components of the signal sensing circuit 154 discussed above. For example, the first, second, third, and fourth signal sensing circuits 302, 304, 306, 308 may each include the first resistor 180, the second resistor 182, the first capacitor 186, and the operational amplifier 192. It should be appreciated that the respective first resistors 180, second resistors 182, and/or first capacitors 186 of the first, second, third, and/or fourth signal sensing circuits 302, 304, 306, 308 may each include resistance/capacitance values that are substantially identical to one another or different from one another.

In the illustrated embodiment, each of the signal sensing circuits 300 is coupled to a common variable resistance element 310 (e.g., a quad-channel digital potentiometer). The common variable resistance element 310 may include a plurality of individually adjustable resistance elements that are each associated with one of the signal sensing circuits 300. For example, the common variable resistance element 310 may include a first variable resistance element 312 corresponding to the first signal sensing circuit 302, a second variable resistance element 314 corresponding to the second signal sensing circuit 304, a third variable resistance element 316 corresponding to the third signal sensing circuit 306, and a fourth variable resistance element 318 corresponding to the fourth signal sensing circuit 308. The common variable resistance element 310 may be operable (e.g., via instructions received from the controller 164) to individually adjust resistance values of each of the first, second, third, and fourth variable resistance elements 312, 314, 316, 318, such that the first, second, third, and fourth variable resistance elements 312, 314, 316, 318 may adjust respective "R-values" of each of the signal sensing circuits 300. Indeed, the common variable resistance element 310 may be communicatively coupled to the controller 164 via one or more control lines 320, such that the controller 164 may instruct the common variable resistance element 310 to adjust the respective resistance values of the first, second, third, and fourth variable resistance elements 312, 314, 316, 318. As such, the controller 164 may adjust the corresponding target cutoff frequencies of respective filters 322 (e.g., multiples of the filter 190) included in each of the signal sensing circuits 300 in accordance with the aforementioned techniques (e.g., based on the size of the VSD 52 to which the adaptive logic board 100 is coupled). It should be appreciated that, in some embodiments, the common variable resistance element 310 may include a pair of dual-channel digital potentiometers or four single-channel digital potentiometers instead of a quad-channel digital potentiometer.

In the illustrated embodiment, each of the signal sensing circuits 300 includes an input terminal 330 configured to receive a corresponding input signal (e.g., the input signal 162) and an output terminal 332 configured to transmit a corresponding output signal (e.g., the output signal 168) to the controller 164 (e.g., to the data logging component 170 of the controller 164). For example, in some embodiments, the first signal sensing circuit 302 may include a first input terminal 331 electrically coupled to and configured to receive an input signal from the first input sensing unit 132 (see FIG. 6), the second signal sensing circuit 304 may include a second input terminal 333 electrically coupled to and configured to receive an input signal from the second input sensing unit 134 (see FIG. 6), the third signal sensing circuit 306 may include a third input terminal 334 electrically coupled to and configured to receive an input signal from the third input sensing unit 136 (see FIG. 6), and the fourth signal sensing circuit 308 may include a fourth input terminal 335 electrically coupled to and configured to receive a fourth input signal from an input sensing unit 336 (see FIG. 5) configured to measure a frequency, voltage, and/or current of electrical energy transmit through the DC link 112. Each of the signal sensing circuits 300 may filter the respective input signals in accordance with the techniques discussed above to provide filtered output signals to the data logging component 170 via the output terminals 332.

As set forth above, embodiments of the present disclosure may provide one or more technical effects useful for enabling a single, adaptive logic board to be implemented with multiple different sizes of VSD to monitor operational parameters of the VSDs of various sizes. The adaptive logic board disclosed herein includes adjustable sensing circuitry that is configured to facilitate monitoring of operational parameters of the VSD at different sampling frequencies that may be selected based on a size of the VSD. As such, the adaptive logic board may be implemented with a variety of differently-sized VSDs to effectively monitor operation of the VSDs. The technical effects and technical problems in the specification are examples and are not limiting. It should be noted that the embodiments described in the specification may have other technical effects and can solve other technical problems.

It should be understood that the application is not limited to the details or methodology set forth in the following description or illustrated in the figures. It should also be understood that the phraseology and terminology employed herein is for the purpose of description only and should not be regarded as limiting.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the VSD and/or the logic board as shown in the various exemplary embodiments is illustrative only. Although only a few embodiments have been described in detail in this disclosure, those who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

The invention claimed is:

1. An adaptive logic board for a variable speed drive (VSD) of a heating, ventilation, air conditioning, and refrigeration (HVAC&R) system, comprising:

a signal sensing circuit configured to receive an input signal from a sensor of the VSD, wherein the signal sensing circuit comprises:

a filter configured to condition the input signal; and a variable resistance element of the filter, wherein the variable resistance element is configured to adjust a cutoff frequency of the filter, and the filter is configured to attenuate waveforms in the input signal having frequencies that exceed the cutoff frequency to generate a conditioned signal; and a controller configured to receive the conditioned signal, wherein the controller is configured to adjust the variable resistance element to adjust the cutoff frequency of the filter based on a parameter of the VSD, wherein the parameter of the VSD comprises a size of the VSD, the controller is configured to adjust the variable resistance element to adjust the cutoff frequency of the filter to a first target cutoff frequency in response to determining that the VSD is a first size, the controller is configured to adjust the variable resistance element to adjust the cutoff frequency of the filter to a second target cutoff frequency in response to determining that the VSD is a second size, the first target cutoff frequency is less than the second target cutoff frequency, and the first size of the VSD has a rated power output greater than the second size of the VSD.

2. The adaptive logic board of claim 1, wherein the controller comprises a data logging component configured to receive the conditioned signal and sample the conditioned signal at a sampling frequency to generate a digital output corresponding to the input signal.

3. The adaptive logic board of claim 2, wherein the controller is configured to adjust the variable resistance element to adjust the cutoff frequency of the filter based on the sampling frequency of the data logging component.

4. The adaptive logic board of claim 3, wherein the controller is configured to determine, or receive feedback indicative of, the size of the VSD, to adjust the sampling frequency of the data logging component based on the size of the VSD, and to adjust the variable resistance element to adjust the cutoff frequency based on the sampling frequency such that the cutoff frequency is a predetermined percentage of the sampling frequency.

5. The adaptive logic board of claim 1, comprising a dual in-line package (DIP) switch communicatively coupled to the controller, wherein the controller is configured to determine the size of the VSD based on a configuration of one or more switches of the DIP switch.

6. The adaptive logic board of claim 1, comprising an external computing device communicatively coupled to the controller, wherein the controller is configured to receive an operator input from the external computing device indicative of the size of the VSD.

7. The adaptive logic board of claim 1, wherein the variable resistance element comprises a digital potentiometer.

8. A heating, ventilation, air conditioning, and refrigeration (HVAC&R) system, comprising:

a variable speed drive (VSD) coupled to a motor of a compressor and configured to control an operational speed of the motor;

a sensor configured to generate an input signal indicative of an operational parameter of the VSD; and an adaptive logic board communicatively coupled to the sensor and the VSD, wherein the adaptive logic board comprises:

a signal sensing circuit comprising a filter configured to receive the input signal from the sensor and to condition the input signal, wherein the filter comprises a variable resistance element adjustable to alter a cutoff frequency of the filter, and the filter is configured to attenuate electrical waveforms of the input signal having frequencies that exceed the cutoff frequency; and a controller configured to adjust the variable resistance element to alter the cutoff frequency of the filter based on a parameter of the VSD, wherein the parameter of the VSD comprises a size of the VSD, the controller is configured to adjust the variable resistance element to adjust the cutoff frequency of the filter to a first target cutoff frequency in response to determining that the size of the VSD is a first size, the controller is configured to adjust the variable resistance element to adjust the cutoff frequency of the filter to a second target cutoff frequency in response to determining that the size of the VSD is a second size, the first target cutoff frequency is less than the second target cutoff frequency, and the first size of the VSD has a rated power output greater than the second size of the VSD.

9. The HVAC&R system of claim 8, wherein the controller is configured to determine the size of the VSD based on:

a configuration of a dual in-line pack (DIP) switch coupled to the adaptive logic board;

an operator input received via an external computing device communicatively coupled to the controller; or a structure of a harness coupling the adaptive logic board to the VSD.

10. The HVAC&R system of claim 8, wherein the filter is configured to attenuate waveforms in the input signal having frequencies that exceed the cutoff frequency to generate a conditioned signal, the controller comprises a data logging component configured to sample the conditioned signal at a target sampling frequency to generate a digital output corresponding to the input signal, and the controller is configured to adjust the variable resistance element to alter the cutoff frequency based on the target sampling frequency.

11. The HVAC&R system of claim 8, wherein the VSD is configured to supply a phase of electrical power to the motor through a power line, and wherein the operational parameter comprises the phase of the electrical power.

* * * * *